United States Patent [19]

Cellerini et al.

[11] 3,949,331

[45] Apr. 6, 1976

[54] CIRCUIT BREAKER WITH ADJUSTABLE THERMAL TRIP UNIT

[75] Inventors: Albert R. Cellerini, Beaver; John P. Majcher, Beaver Falls, both of Pa.

[73] Assignee: Westinghouse Electric Corporation, Pittsburgh, Pa.

[22] Filed: May 15, 1974

[21] Appl. No.: 470,107

[52] U.S. Cl. ..... 335/45; 335/176

[51] Int. Cl.[2] ..... H01H 75/12

[58] Field of Search ..... 335/8, 9, 10, 42, 45, 176

[56] References Cited

UNITED STATES PATENTS

| | | | |
|---|---|---|---|
| 3,345,591 | 10/1967 | Leonard et al. | 335/8 X |
| 3,355,685 | 11/1967 | Leonard et al. | 335/8 |
| 3,460,075 | 8/1969 | Yorgin et al. | 335/9 |
| 3,758,887 | 9/1973 | Ellsworth et al. | 335/42 X |

*Primary Examiner*—G. Harris

*Attorney, Agent, or Firm*—L. P. Johns

[57] ABSTRACT

A circuit breaker characterized by a stored energy mechanism and an improved resettable latch means which latch means include an adjustable thermal trip unit.

4 Claims, 1 Drawing Figure

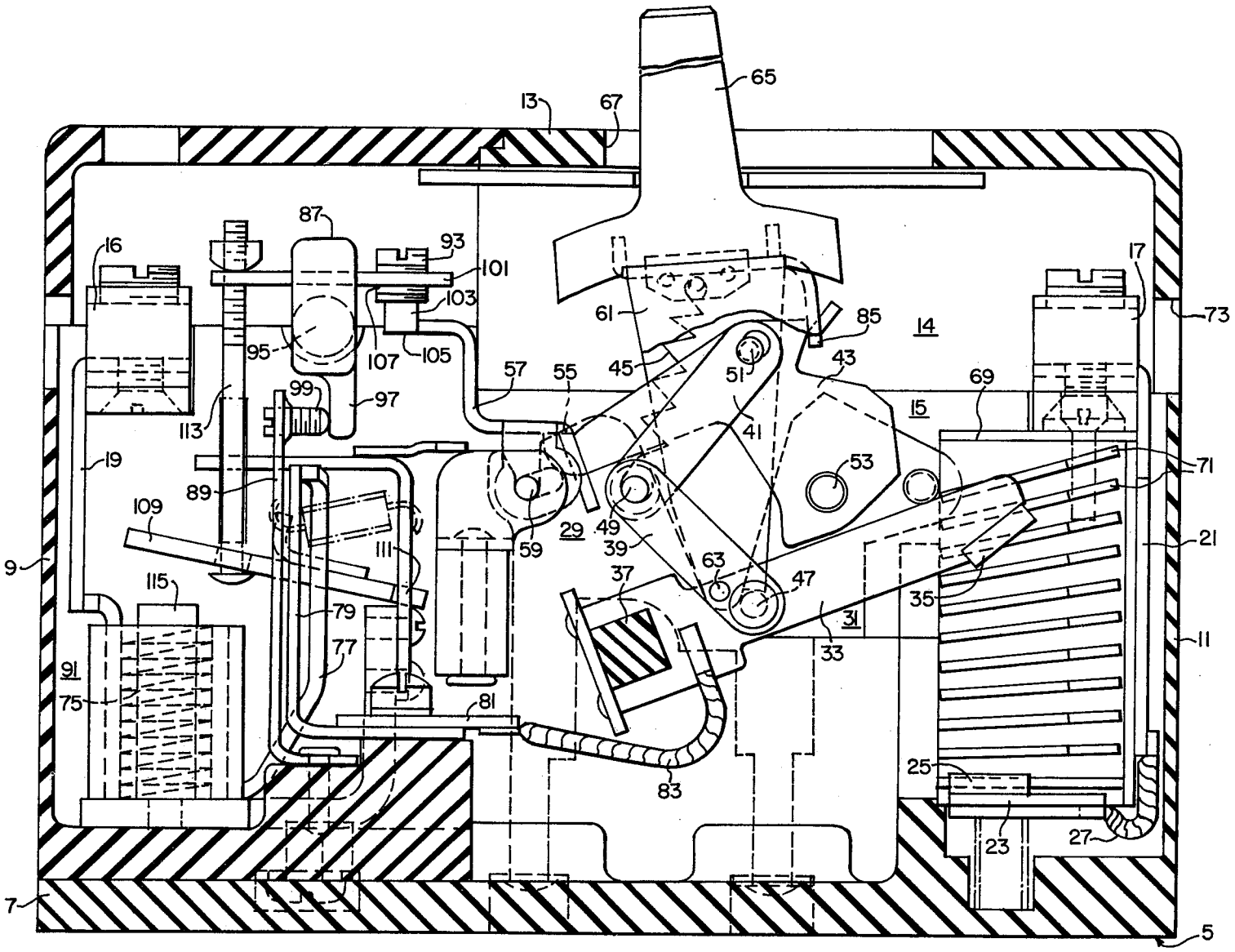
5
7
9
11
13
14
15
16
17
19
21
23
25
27
29
31
33
35
37
39
41
43
45
47
49
51
53
55
57
59
61
63
65
67
69
71
73
75
77
79
81
83
85
87
89
91
93
95
97
99
101
103
105
107
109
111
113
115

CIRCUIT BREAKER WITH ADJUSTABLE THERMAL TRIP UNIT

CROSS REFERENCE TO RELATED APPLICATION

Cross reference is made to copending applications of E. J. Walker, Ser. No. 345,396, and now U.S. Pat. No. 3,810,051; and J. G. Salvati, Ser. No. 346,230 and now U.S. Pat. No. 3,797,007; both filed Mar. 29, 1973.

BACKGROUND OF THE INVENTION

1. Field of the Invention

This invention relates to circuit breakers and, more particularly, to circuit breakers of the type comprising an adjustable thermal trip unit.

2. Description of the Prior Art

A circuit breaker having an operating mechanism of the type disclosed herein is disclosed in the patent to Albert R. Cellerini, U.S. Pat. No. 3,662,134. A circuit breaker comprising a stored energy mechanism having a latch structure is disclosed in the patent to Nick Norgian et al., U.S. Pat. No. 3,460,075. A latch structure of the subject invention constitutes a modification over the foregoing prior art in that adjustable thermal trip means are utilized to change the rating of thermal elements of all poles with one adjustment.

Associated with the foregoing in an arrangement of terminals at the top of the circuit breaker where dead space otherwise exists to enable a reduction in the length of circuit breaker by a distance equal to approximately twice the width of the terminals.

SUMMARY OF THE INVENTION

A circuit interrupter trip unit comprising a circuit breaker mechanism within a housing and comprising stationary and movable contacts adapted to be connected as part of a distribution unit, a housing comprising opposite pairs of side walls, end walls, and top and bottom walls, and enclosing a chamber, an arc chute around the path of movement of the movable contact, the circuit breaker mechanism comprising a releasable member movable when released from a latched position to effect opening of the contacts, a trip bar movable to a trip position to effect release of the releasable member and being biased to a latch position, an elongated bimetal movable in response to abnormal currents to effect movement of the trip bar to the unlatched position, adjustable means on the trip bar including a threaded screw for increasing and decreasing the amount of the trip bar required for releasing the releasable member, a stationary magnetic structure for each conductor of the distribution system and comprising a coil and core assembly, first conductor means leading from each stationary contact and comprising a first terminal located in the chamber and between the top wall and the arc chute, and second conductor means leading from each movable contact and comprising a second terminal located in the chamber and between the top wall and the stationary magnetic structure.

The advantage of the device of this invention is that it enables a change in the rating of the thermal elements with a single adjustment and with the device also provides for a decrease of the length of the circuit breaker.

BRIEF DESCRIPTION OF THE DRAWING

The single view of the drawing is a vertical sectional view through one pole of a multipole circuit breaker.

DESCRIPTION OF THE PREFERRED EMBODIMENT

In the drawing the center pole unit of the three-pole molded-case or insulating-housing type of circuit breaker is generally indicated at 5. It comprises an insulating housing comprising a molded insulating base 7 including opposite end walls 9 and 11, and a detachable molded insulating cover or top wall 13. Opposite side walls, of which one side wall 14 is shown, are also part of the insulating housing. Suitable insulating barriers 15 separate the housing chamber into three adjacent insulating compartments for housing the three-pole units of the three-pole circuit breaker in a manner well known in the art. In each pole unit, two terminals 16 and 17 are provided in proximity to the opposite end walls 9 and 11 of the housing to enable the circuit breaker in an electric distribution.

In each of the three-pole unit compartments of the circuit breaker, there are two spaced conductors 19, 21 leading to the terminals 16, 17, respectively. A stationary contact 25 is secured to a conductor 23 which is connected to the conductor 21 by a flexible conductor 27.

A single stored-energy type of operating mechanism 29 for controlling all three-pole units is mounted in the center pole unit of the circuit breaker. The operating mechanism 29 is operable to move a movable contact structure, generally indicated at 31, between opened and closed positions. The movable contact structure 31 is of the type more specifically described in the Cellerini U.S. Pat. No. 3,662,134. Generally, it comprises a contact arm 33 on which a movable contact 35 is mounted, and a rigid insulating tie bar 37 about which the contact arms 33 rotate. The movable contact structure 31 is moved between the opened and closed position by the stored energy mechanism 29 which comprises a lower toggle link 39, an upper toggle link 41, a releasable trip member or cradle 43, and tension spring 45. The contact arm 33, for the center pole unit, is pivotally connected to the lower toggle link 39 by a pivot pin 47. The lower link 33 is pivotally connected to the upper toggle link by a knee pivot pin 49. The upper toggle link 41 is pivotally connected to the releasable trip member 43 by pivot pin 51. The releasable trip member 43 is supported at one end for pivotal movement above a fixed pin 53 at one end thereof and the other end is latched at 55 on a trigger or lever 57 which is pivotally mounted at 59.

An inverted generally U-shaped operating lever 61 is supported at the inner end of the legs thereof for pivotal movement on a pair of fixed pins 63. The tension spring 45 is connected at the lower end to the knee pivot 49 and at the upper end to the bight portion of the operating lever 61. A handle 65 is connected to the upper end of the operating lever 61 and extends through an opening 67 in a drop wall 13.

In each pole unit, an arc extinguishing structure or arc chute 69, comprising a plurality of generally U-shaped magnetic plates 71 is supported in spaced stacked relationship. The arc extinguishing structure 69 operates to extinguish arcs drawn between the contacts 35, 25 during opening operations in a manner well known in the art.

The terminal 17 is located in the chamber between the arc extinguishing structure 69 and the top walls 13 and thereby conserves space and results in a decrease in the overall length of the circuit breaker between the end walls 9 and 11. An opening 73 is provided in the cover 13 adjacent to the terminal 17, whereby a cable may be attached to the terminal.

As shown in the drawing, the circuit breaker 5 is in the open position with a releasable trip member 43 latched in the latched position by means of the trigger or latch lever 57. To close the circuit breaker the handle 65 is moved in the clockwise direction from the "off" or open position to the "on" or closed position to move the operating lever 61 clockwise about the pivot 63. During this movement the overcenter springs 45 are moved over center to erect the toggle links 39, 41 in order to pivot the movable contact structure 31 of the center pole unit in a clockwise direction about the axis of the tie bar 37 to the closed position. The three contact carriers of the circuit breakers are thereby connected for simultaneous movement by the tie bar 37. A closed circuit through the circuit breaker 5 extends from the terminal 16 through the conductor 19, a magnetic coil 75, a conductor 77, a conductor 79, a conductor 81, a flexible conductor 83, the conductor arm 33, the contacts 25, 35, and the conductors 23, 27, and 21 to the terminal 17. To open the circuit in the circuit breaker the handle 65 is moved counterclockwise to the on position as shown in the drawing.

When the circuit breaker is in the closed position and an overload occurs in any of the three-pole units, the releasable trip member 43 is released, in a manner hereinafter described, to automatically trip the circuit breaker open. Upon release of a releasable trip arm 43, the springs 45 which are in the charged condition, rotate the releasable trip member 43 in a clockwise direction about the pivot 53 to cause collapse of the toggle 39, 41 to thereby move the three contact carriers 33 to the open position in a manner well known in the art. Upon tripping movement of the circuit breaker, the handle 65 is moved to an intermediate position in between the "off" and "on" positions to provide a visual indication that the circuit breaker is tripped open.

Following a tripping operation, it is necessary to reset and relatch the circuit breaker mechanism before the contacts can be closed. Resetting and relatching is achieved by moving the handle 65 to a high position past the "off" position. During this movement a flange 85 is pressed against the upper side of the releasable trip member 43 causing it to rotate counterclockwise about the pin 53, whereby the releasable trip member 43 is moved down to a position to relatch the trigger or latch lever 57 at 55. Following relatching of the latch lever 57, when the operator releases the handle 65, the releasable trip member 43 will again be reset and relatched in the position shown in the drawing. Thereafter the circuit breaker can be operated in the same manner as described above.

In accordance with this invention the circuit breaker comprises a trip bar 87, the trigger or latch lever 57, a bimetal 89, a stationary magnetic structure 91 including the coil 75, and adjustable means comprising a latch screw 93. The trip bar 87 is journally mounted at 95 and is preferably composed of electrically insulating material. Moreover, it is coextensive with the three poles of the circuit breaker 5. In each pole the trip bar 87 is provided with a finger 97 which is engaged by a calibration screw 99 at the upper end of each bimetal 89. The conductor 79 is composed of a material that is heated in the event of an overload current of a prescribed rating, whereupon the bimetal 89 moves to the right as viewed in the drawing and against the finger 97.

Continued movement of the bimetal 89 rotates the trip bar 87. The latch screw 93, being mounted on the trip bar 87 by a lateral extension or lever 101, includes a lower end portion 103 which cooperates with the trigger or latch lever 57 to retain a releasable trip member 43 in place. Upon rotation of the trip bar 87 that latch screw 93 moves upwardly out of engagement with the upper end of the latch lever 57, whereupon the lever rotates counterclockwise around its pivot 59 and releases the left end of the releasable member 43. The distance to which the latch screw 93 must be moved to release the trigger or latch lever 57 is dependent upon the location of the lower end surface 105 of the lower end portion 103 with respect to the end of the lever. The latch screw 93 is limited to one full turn by means of a mechanical stop 107 on the extension 101 and the screw thread is proportioned to permit an approximate 20% adjustment of the nominal thermal rating of the breaker. Accordingly, rotation of the latch screw 93 to move the lower end surface 105 up or down with respect to the end of the latch lever 57 offers a distance through which the tie bar 87 must move in order to release the releasable trip member 43.

In addition, the tie bar 87 is adapted to be actuated by the stationary magnetic structure 91 by providing an armature lever 109 which is pivoted at 111 and connecting the lever by a link 113 which extends to the extension 101 on the tie bar. When an excessive overload current passes through the coil 75, the armature lever is attracted to a core 115 of the stationary magnetic structure 91, thereby rotating the tie bar 87 counterclockwise and lifting the lower end 105 above the end of the latch lever 57.

Accordingly, the circuit breaker of this invention provides a trip unit having an adjustable thermal means for changing the rating of the several thermal elements of the three pole units with a single adjustment; namely, the match screw 93. Finally, the circuit breaker of this invention has a length which is shorter than that of circuit breakers of comparable rating due to the placement of the terminals in locations within the cover of the breaker rather than in locations on opposite side of the stationary magnetic structure and the arc chute.

What is claimed is:

1. A circuit interrupter trip unit comprising a circuit breaker mechanism having separable contacts adapted to be connected as part of a distribution system, the circuit breaker mechanism comprising a releasable member movable when released from a latched position to effect opening of the contacts, a trip bar movable to a tripped position to effect release of the releasable member and being biased in the latched position, a stationary magnetic structure of each conductor of the distribution system and comprising a coil and core assembly and movable in response to excessive overload currents, a lever armature associated with each stationary magnetic structure and operatively connected to the trip bar for moving the trip bar to the unlatched position, an elongated bimetal movable in response to overload currents to effect movement of the trip bar to the unlatched position, and adjustable means on the trip bar for increasing and decreasing the amount of movement of the trip bar required for releasing the releasable member.

2. The trip unit of claim 1 in which the adjustable means comprises a threaded member.

3. The trip unit of claim 1 in which a trigger lever is operatively mounted between the releasable member and the adjustable means.

4. The trip unit of claim 3 in which the trip bar is rotatable on its longitudinal axis and comprises laterally extending means operatively connected to the lever-armature and the threaded member being mounted on the laterally extending means.

* * * * *